United States Patent [19]

Gentilcore et al.

[11] Patent Number: 4,750,703

[45] Date of Patent: Jun. 14, 1988

[54] FORM ASSEMBLY FOR CEMENT

[76] Inventors: John Gentilcore, 1600 Villanova Rd., Pittsburgh, Pa. 15206; Sandra Macpherson, Allegheny River Blvd. & James St., Verona, Pa. 15147; Joseph A. Pucciarelli, 103 S. Harleston Dr., Pittsburgh, Pa. 15237

[21] Appl. No.: 88,401

[22] Filed: Aug. 24, 1987

[51] Int. Cl.[4] ..... E01C 19/50

[52] U.S. Cl. ..... 249/6; 249/4; 249/192; 249/196

[58] Field of Search ..... 249/2–8, 249/44, 47, 165, 189, 192, 193, 196, DIG. 3

[56] References Cited

U.S. PATENT DOCUMENTS

| | | | |
|---|---|---|---|
| 1,202,269 | 10/1916 | Cramer | 249/6 |
| 1,911,146 | 5/1933 | Diehl | 249/192 |
| 2,846,748 | 8/1958 | Owen et al. | 249/7 |
| 3,778,019 | 12/1973 | Stegmeier | 249/189 |
| 3,930,633 | 1/1976 | Wolf | 249/192 |
| 4,202,145 | 5/1980 | Coulter et al. | 249/6 |
| 4,340,200 | 7/1982 | Stegmeier | 249/3 |
| 4,579,312 | 4/1986 | White | 249/6 |

FOREIGN PATENT DOCUMENTS

| | | | |
|---|---|---|---|
| 274713 | 7/1964 | Australia | 249/6 |

*Primary Examiner*—Jay H. Woo
*Assistant Examiner*—James C. Housel
*Attorney, Agent, or Firm*—Buell, Ziesenheim, Beck & Alstadt

[57] ABSTRACT

A form assembly for cement or the like comprising interlocking form members. One form member is longitudinally straight and can be provided with horizontal stiffening ribs at its upper and lower edges. The other form member has upper and lower ledges at least one end and is resiliently flexible to permit bending into a longitudinally curved configuration. The ends of the form members are each cut away into complementary shapes to form an interlocking joint. The upper and lower horizontal ribs are provided with a first set of vertically aligned openings in the vicinity of the cut away joint and the upper and lower ledges are provided with a second set of vertically aligned openings in the vicinity of the cut away joint. The ribs and the ledges overlap each other so that the first and second set of aligned openings are in vertical alignment with each other when the cut away joints are interlocked, allowing a pin to be received by the aligned openings to fix the assembly into the ground. Thereupon, the flexible form can be resiliently bent and retained in a curved configuration.

9 Claims, 2 Drawing Sheets

FORM ASSEMBLY FOR CEMENT

Figure 1:
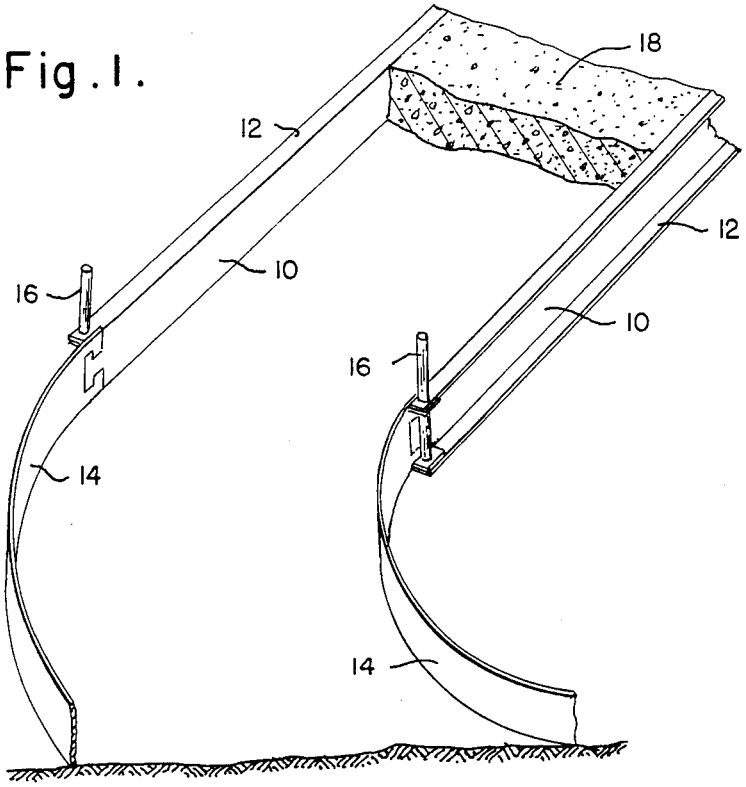

This invention relates to a form assembly for shaping a mortar such as cement, concrete or like material.

This invention relates to a form assembly comprising at least two sections including a longitudinally straight section and a longitudinally curved section. The straight section can comprise any suitable material, such as wood or plastic. The straight section can be rigid and provided with horizontal reinforcing ribs along its entire length. The curved section can comprise a resilient flexible material, such as plastic. A suitable plastic material for both the straight and curved sections, but particularly for the curved section, is a material sold under the trademark AZDEL, a product of PPG Industries, Inc. comprising a glass fiber-reinforced plastic. The plastic can be a thermoplastic. Examples of plastic include polyethylene terephthalate and polypropylene. The material of the curved section is normally straight but is resiliently bendable into a curved configuration by flexing. The curved section is fastened or secured into a curved position when being used. The curved section is not provided with reinforcing ribs which can interfere with bending. The assembly can be disassembled after use and subsequently reused. Upon disassembly, the resiliency of the curved section allows it to reassume its straight condition.

More particularly, the form assembly comprises first and second form members. The first form member can comprise a first vertically standing wall member having upper and lower horizontal reinforcing ribs along the upper and lower edges on one side thereof. A portion of an end of the first wall is cut away to define a first segment of an interlocking joint. First openings aligned on a vertical axis are provided in the upper and lower ribs, respectively, in the vicinity of said first segment.

The second form member comprises a second vertically standing wall member. Upper and lower horizontal ledges are mounted at one end of the second wall member on one side thereof. The upper and lower ledges are disposed inwardly from the upper and lower edges, respectively, of the second wall member. Second openings aligned on a vertical axis are disposed in the upper and lower ledges, respectively. The end of the second wall member is cut away to define a second segment of the interlocking joint complementary to the first segment.

The upper and lower ledges overlap the upper and lower ribs, respectively, so that the first aligned openings and the second aligned openings are all aligned on a vertical axis with each other when the first segment and the second segment are interlocked. A pin extends vertically through said first aligned openings and said second aligned openings for securing the assembly and pinning it into the ground. The first wall member remains longitudinally straight while the second wall member is subsequently bent longitudinally and secured at its opposite end to maintain a curved configuration. When the openings in the ledges are close to or touch the inward edges of the ledges and the openings in the ribs are close to or touch the inward edges of the ribs, the joining pin gives a high degree of support to the joint upon bending of the second member.

Figure 2:
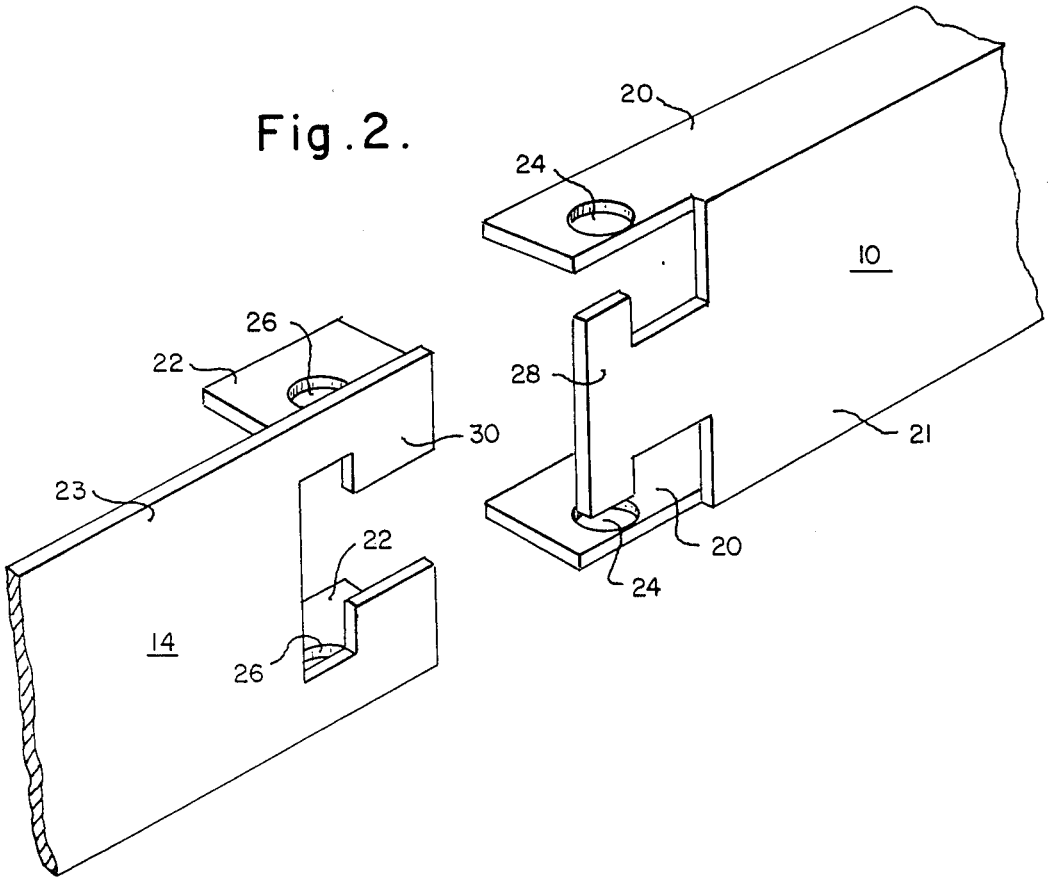
Figure 3:
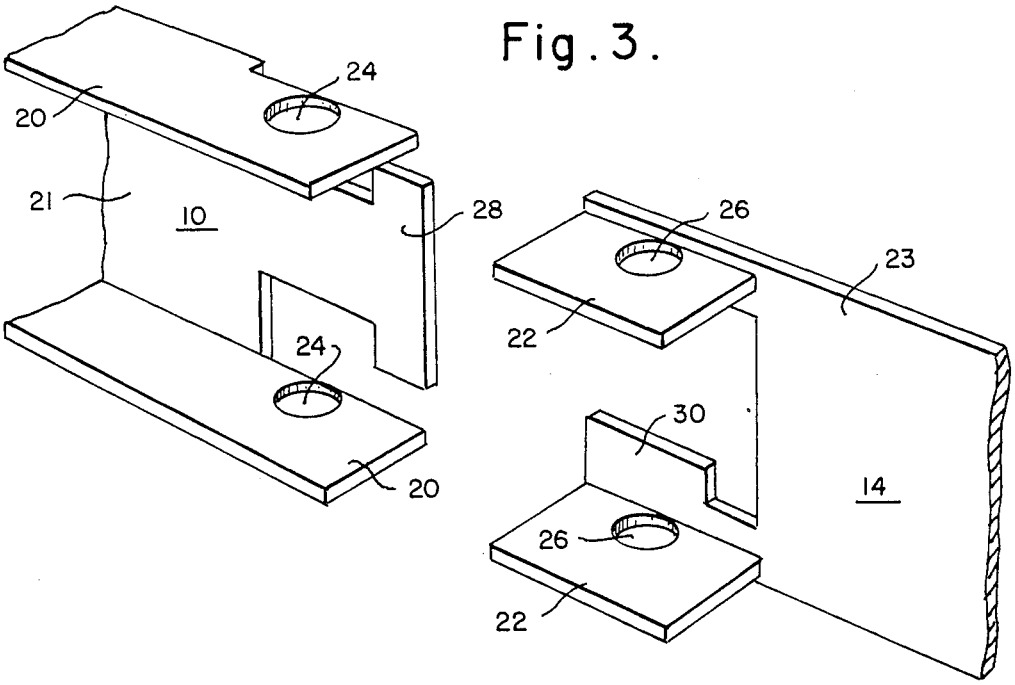
Figure 4:
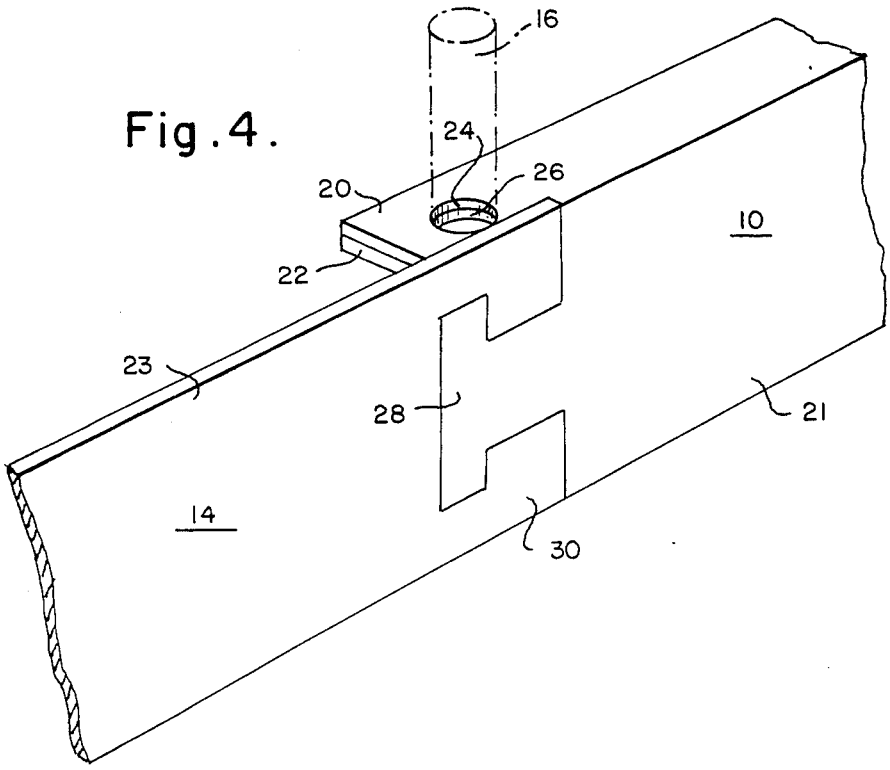

This invention will be more fully understood by reference to the attached figures in which:

FIG. 1 shows a straight form and a curved form connected in operative relationship, FIG. 2 is an exploded view of the exterior of an interlocking joint, FIG. 3 is an exploded view of the interior of an interlocking joint, and FIG. 4 is a view of a connected interlocked joint.

FIG. 1 shows form 10 comprising a vertical member having upper and lower horizontal stiffening ribs 12 to provide a straight unbent section. Stiffening ribs 12 extend outwardly at the upper and lower edges of form 10. Form 14 comprises bent vertical members which are resiliently flexed into a desired radius of curvature. Form 14 can be attached at both ends, although attachment at only one end is shown. Form 14 is normally straight and can be manually flexed and then secured into a bent condition. Form 14 will spring back into a straight condition upon release. The forms are secured to each other and to the ground by vertical pins or spikes 16. The forms are used to contain and shape a bed of wet concrete or cement 18.

As shown in FIGS. 2 and 3, the ends of the forms are provided with interlocking complementary cut away connector designs, respectively. Form 10 has vertical web 21 with upper and lower horizontal ribs or flanges 20 and form 14 has vertical web 23 with abbreviated upper and lower horizontal ledges 22 at its ends. Ribs or flanges 20 have vertically aligned circular bores 24. Ledges 22 have vertically aligned circular bores 26. Ledges 22 are offset slightly inboard from the outer edges of web 23 by an amount sufficient to accommodate the thickness of ribs 20, which are positioned at the outboard edges of web 21.

Vertically aligned bores 24 are located close to and substantially tangent to the inner edge of ribs 20. Vertically aligned bores 26 are located close to and substantially tangent to the inner edges of ledges 22, as best shown in FIG. 3.

As shown in FIGS. 2 and 3, forms 10 and 14 have complementary and interlocking connector joints 28 and 30, respectively. FIG. 4 shows joints 28 and 30 interlockedly connected with each other. At the same time, outboard rib 20 is mounted above and in overlapping relationship with respect to inboard ledge 22 so that circular bores 24 and 26 are vertically aligned with each other. The assembly can be locked together and to the ground by means of vertical spike 16 which is pushed through upper and lower openings 24 and 26, respectively, and secured into the ground.

The close and substantially tangential or abutting positioning of circular bores 24 and 26 with respect to their respective vertical web members 21 and 23 allows pin 16 to give support to the connection so that form 14 may be bent into the desired curve without disturbing the connection with form 10.

While we have illustrated and described a present preferred embodiment of our invention, it is to be understood that we do not limit ourselves thereto and that our invention may be otherwise variously practiced within the scope of the following claims.

We claim:

1. A form for shaping cementitious materials comprising first and second interlocking form members; said first form member having a vertical web with upper and lower horizontal ribs adjacent the upper and lower edges of said web, respectively; a portion of the web at at least one end of said first form member being cut away to define a first segment of an interlocking joint; first vertically aligned openings disposed in said upper and lower horizontal ribs in said first segment; said second form member having a vertical web with upper and lower horizontal ledges at at least one end thereof; said upper and lower ledges disposed inwardly from the upper and lower edges, respectively, of the web of said second form member; second vertically aligned openings in said upper and lower ledges adjacent the web; a portion of the web in said end of said second form member being cut away to define a second segment of an interlocking joint complementary with said first segment; said upper and lower ledges being overlapped by a portion of said upper and lower ribs, respectively, so that said first aligned openings and said second aligned openings are vertically aligned with each other when said first segment and said second segment form said interlocking joint.

2. The form of claim 1 including a pin through said first openings and said second openings when they are vertically aligned with each other.

3. The form of claim 1 wherein said first openings are each substantially tangent to the inward edges of said ribs adjacent the plane of the web of said first form member and said second openings are each substantially tangent to the inward edges of said ledges adjacent the web of said second form member.

4. The form of claim 1 wherein said first form member is not flexible and is straight and said second form member is flexible for bending into a curved configuration.

5. The form of claim 1 including a pin through said first aligned openings and said second aligned openings, said pin extending into the ground and said second form member being bent and restrained into a curved shape.

6. The form of claim 1 wherein said first form member comprises glass fiber-reinforced plastic.

7. The form of claim 1 wherein said second form member comprises glass fiber-reinforced plastic.

8. A form assembly for shaping cementitious materials comprising first and second form members; said first form member comprising a first vertically standing wall member; upper and lower horizontal ribs at the upper and lower edges, respectively, of said first wall member on the same side thereof; a portion of at least one end of said first wall member being cut away to define a first segment of an interlocking joint; first vertically aligned openings disposed in said upper and lower ribs, respectively, in the vicinity of said first segment; said second form member comprising a second vertically standing wall member; upper and lower horizontal ledges mounted at at least one end of said second wall member on the same side thereof; said upper and lower ledges disposed inwardly of the upper and lower edges, respectively, of said second wall member; second vertically aligned openings in said upper and lower ledges, respectively; said end of said second wall member being cut away to define a second segment of said interlocking joint complementary with said first segment; said upper and lower ledges being overlapped by said upper and lower ribs, respectively, so that said first aligned openings and said second aligned openings are vertically aligned with each other when said first segment and said second segment are interlocked; a pin extending vertically through said first aligned openings and said second aligned openings for pinning said assembly to the ground; said first wall member being longitudinally straight and said second wall member being longitudinally bent and secured into a curved configuration.

9. The form assembly of claim 8 wherein each of said first aligned openings comprises a circular hole which is substantially tangent to the inward edge of its respective rib and each of said second aligned openings comprises a circular hole which is substantially tangent to the inward edge of its respective ledge.

* * * * *